US005278622A

United States Patent [19]

Segawa

[11] Patent Number: 5,278,622

[45] Date of Patent: Jan. 11, 1994

[54] IMAGE FORMING APPARATUS WITH IMPROVED DOCUMENT FEEDING SYSTEM

[75] Inventor: Hiroyuki Segawa, Yokohama, Japan

[73] Assignee: Kabushiki Kaisha Toshiba, Kawasaki, Japan

[21] Appl. No.: 916,397

[22] Filed: Jul. 20, 1992

[30] Foreign Application Priority Data

Jul. 31, 1991 [JP] Japan ..... 3-191662

[51] Int. Cl.[5] ..... G03G 15/00; G03G 21/00

[52] U.S. Cl. ..... 355/308; 271/264; 271/265

[58] Field of Search ..... 355/308, 321, 316, 317; 271/264, 265, 266, 270

[56] References Cited

U.S. PATENT DOCUMENTS 4,849,786 7/1989 Murakami ..... 355/311
4,912,518 3/1990 Matsuo et al. ..... 355/317
4,996,568 2/1991 Hamakawa ..... 355/308
5,118,089 6/1992 Yamada et al. ..... 271/265 X
5,119,145 6/1992 Honjo et al. ..... 271/265 X

*Primary Examiner*—A. T. Grimley
*Assistant Examiner*—Sandra L. Brasé
*Attorney, Agent, or Firm*—Limbach & Limbach

[57] ABSTRACT

A conveyor belt for feeding an image-scanned original present at an image scanning position to an intermediate position located between the image scanning position and a paper discharge tray is arranged, so that the next original is fed to the image scanning position before a copied original is discharged to the paper discharge tray. Since each scanned original is fed to the intermediate position, the next original can be fed when the original at the image scanning position reaches the intermediate position. Therefore, the feed operation of the next original need not wait until the original at the image scanning position is discharged to the paper discharge tray, and the original-replace processing time can be shortened.

8 Claims, 17 Drawing Sheets

IMAGE FORMING APPARATUS WITH IMPROVED DOCUMENT FEEDING SYSTEM

BACKGROUND OF THE INVENTION

1. Field of the Invention

The present invention relates to an auto document feeder, which is attached to, e.g., an electronic copying machine, and particularly has an improved original discharge process.

2. Description of the Related Art

As a conventional auto document feeder to be attached to an electronic copying machine, U.S. Pat. No. 4,849,786 is known. This feeder automatically separates a plurality of originals stacked on a paper supply tray, and feeds the separated originals to an image scanning position on an original table one by one. After an image-scanned original is discharged, this feeder feeds the next original to the image scanning position.

In the auto document feeder, an operation for discharging a scanned original onto a paper discharge tray is performed by a conveyor belt on the original table. The timing of this operation is synchronized with an original feeding operation for feeding an original to the image scanning position. More specifically, a process for discharging one image-scanned original present at the image scanning position onto the paper discharge tray, and then feeding the next original to the image scanning position is repeated, thus attaining original replace processing.

The conventional auto document feeder repeats a process for feeding an original to the image scanning position on the original table one by one, discharging the scanned original from the original table, and simultaneously feeding the next original to the image scanning position, regardless of the original size in the original feed direction. For this reason, as the original size in the original feed direction becomes shorter, the interval between adjacent originals is widened, and the time required for replacing originals is undesirably prolonged.

In the conventional auto document feeder, when two adjacent originals are to be successively discharged onto the paper discharge tray, a normal feed speed is switched to a low feed speed during a feed operation of each original. For this reason, when the discharge interval between originals to be discharged is shortened, before the first original is discharged from a paper discharge port and lands on the paper discharge tray, the next original is discharged from the paper discharge port, and the leading end of the latter original collides against the trailing end of the former original. Thus, the original discharged first may jump out forward, or the original discharged later may be jammed at the paper discharge port.

SUMMARY OF THE INVENTION

It is, therefore, the first object of the present invention to provide an auto document feeder, which can shorten the time required for replacing originals regardless of an increase in original feed speed.

It is the second object of the present invention to provide an auto document feeder, which can improve alignment of discharged originals on a paper discharge section (paper discharge tray), and can prevent a discharge error in a paper discharge/feed operation, so that an original discharge operation can always be stably performed.

In order to achieve the first object, an auto document feeder of the present invention comprises a paper supply section on which a plurality of originals are placed, feed means for feeding an original on the paper supply section to an image scanning position, and discharging the original at the image scanning position, a discharge section for storing the original discharged by the feed means, detection means for detecting if the originals are placed on the paper supply section in a state wherein the original is fed to the image scanning position by the feed means, and control means for, when the detection means is in a detection state, and when the feed mean feeds the next original to the image scanning position, controlling to feed the next original to the image scanning position, while feeding the original already present at the image scanning position to a intermediate position between the image scanning position and the discharge section.

In order to achieve the second object, an auto document feeder of the present invention comprises a paper supply section on which a plurality of originals are placed, feed means for feeding an original on the paper supply section to an image scanning position, and discharging the original at the image scanning position, a discharge section for storing the original discharged by the feed means, detection means for detecting if the originals are placed on the paper supply section in a state wherein the original is fed to the image scanning position by the feed means, original feed amount detection means for detecting an original feed amount of an original fed from an intermediate position to the discharge section, last original detection means for detecting if the original fed by the feed means is the last original, and control means for, when the detection means is in a detection state, and when the feed means feeds the next original to the image scanning position, controlling to feed the next original to the image anning position, while feeding the original already present at the image scanning position to an intermediate position between the image scanning position and the discharge section, for, when the original is present at the intermediate position, controlling to discharge the original at the intermediate position to the discharge section and to decrease an original feed speed when the original feed amount from the intermediate position to the discharge section detected by the original feed amount detection means reaches a predetermined amount, and for, when the last original detection means detects the last original, controlling to set a feed speed of the detected last original to be a decreased speed independently of the original feed amount detected by the original feed amount detection means so as to prevent the last original from contacting the immediately preceding original The auto document feeder of the present invention feeds an image-scanned original to the intermediate position, and then, feeds the next original to the image scanning position. When the image scanning processing of the original at the image scanning position is ended, the original at the intermediate position is fed to the discharge section. When the original is fed from the intermediate position to the discharge section by a predetermined amount, the original feed speed is decreased. When the original at the intermediate position is fed to the discharge section, an image-scanned original is simultaneously fed to the intermediate position. In this manner, original replace operations are sequentially performed within a short period of time.

Unlike other previous originals, the image-scanned last original is not decelerated after it is fed by a third feed device by a predetermined amount, but is decelerated in advance so as not to contact the immediately preceding original. In this manner, a time from when the immediately preceding original is discharged onto the discharge section until the leading end of the following last original reaches a paper discharge port is prolonged. Thus, the last original is discharged after the immediately preceding original perfectly lands. Therefore, alignment of originals on the discharge section can be improved, and a stable discharge operation can always be performed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below serve to explain the principles of the invention.

DETAILED DESCRIPTION OF THE PREFERRED EMBODIMENT

An embodiment of the present invention will be described hereinafter with reference to the accompanying drawings.

Figure 1:
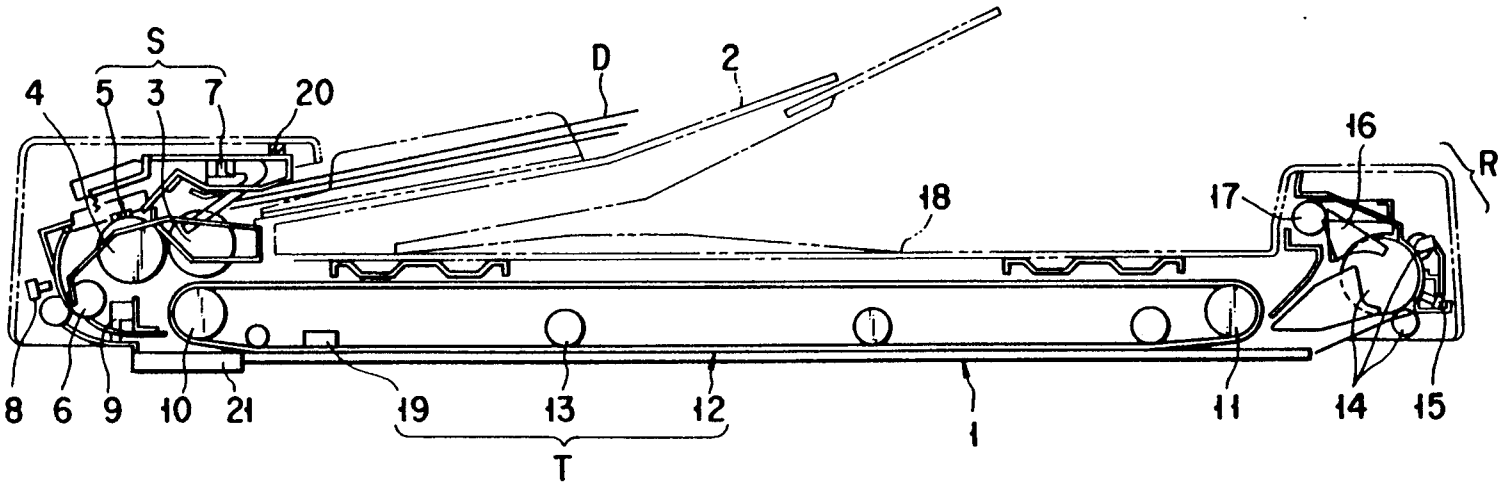
FIG. 1 is a schematic sectional view showing the arrangement of an auto document feeder.

FIG. 1 is a schematic sectional view showing the arrangement of an auto document feeder mounted on an electronic copying machine.

The auto document feeder comprises paper supply section S for picking up originals D set thereon one by one, and supplying the picked-up original, feed section T for feeding original D supplied from the paper supply section onto original table 1, i.e., to an exposure position (image scanning position) of the electronic copying machine, and feeding original D from the position on original table 1 to reverse discharge section R after exposure processing of the electronic copying machine is completed, and reverse discharge section R for reversing or discharging original D fed from the feed section as needed. This feeder is openably arranged on original table 1, and also serves as an original table cover.

Paper supply section S comprises paper supply tray 2 on which a plurality of originals D are set in a stacked state, pick-up roller 3 for picking up originals D set on paper supply tray 2 one by one, separation roller 4 for feeding original D picked up by pick-up roller 3, separation pad 5 contacting separation roller 4, and aligning roller pair 6 for feeding original D fed by separation roller 4 while aligning it. Empty sensor 7 for detecting the presence/absence of originals D is arranged above paper supply tray 2 at the side of separation roller 4. Regist sensor 8 is arranged in front of aligning roller pair 6. Size sensor 9 for detecting the size of original D is arranged behind aligning roller pair 6.

Feed section T comprises endless conveyor belt 12, looped between belt rollers 10 and 11, for feeding supplied original D along original table 1, and belt pressing rollers 13 for pressing conveyor belt 12 against original table 1.

Reverse discharge section R comprises reverse roller group 14 for receiving original D supplied from the feed section, reversing the original, and then guiding the original to the feed section, and paper discharge roller 17 for guiding original D toward paper discharge tray 18. Paper discharge sensor 15 is arranged among reverse roller group 14. Flapper 16 is arranged between paper discharge roller 17 and reverse roller group 14. By driving flapper 16, original D from the feed section is fed back to the feed section, or is guided to paper discharge tray 18. Normally, flapper 16 is set to guide original D from the feed section to paper discharge tray 18, and is driven by a flapper solenoid (not shown).

Note that reference numeral 19 denotes an auto document feeder (auto document) open sensor for detecting if this feeder is open with respect to original table 1; 20, a cover open sensor for detecting an open/closed state of an open/close cover for covering the paper supply section; and 21, an original stopper for aligning an original on original table 1.

Figure 2:
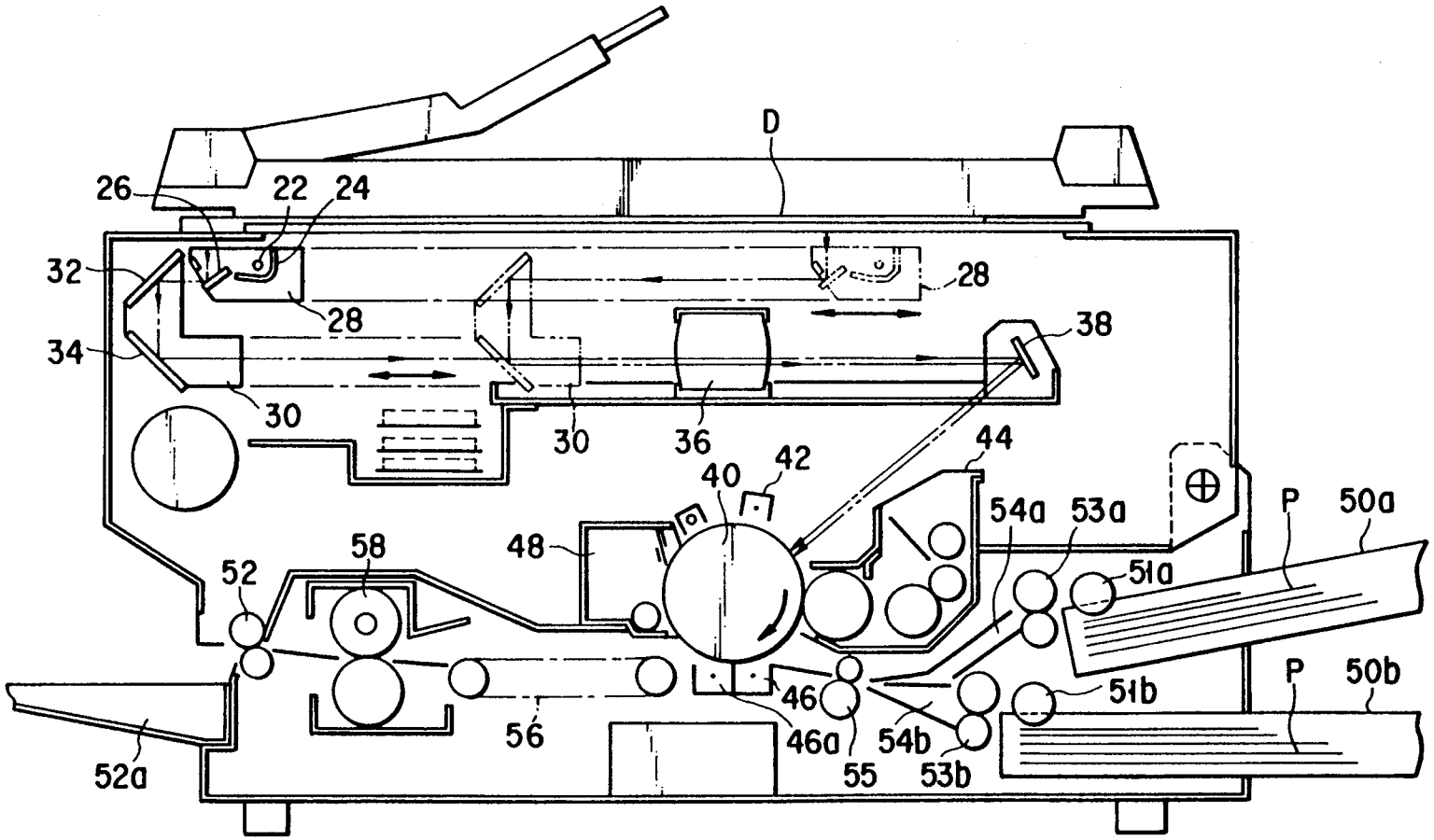
FIG. 2 is a schematic sectional view showing an electronic copying machine, which mounts the auto document feeder.

FIG. 2 is a schematic sectional view of an electronic copying machine, which mounts this auto document feeder.

The electronic copying machine comprises original table 1 on its upper portion, and the above-mentioned auto document feeder is mounted on original table 1.

First and second carriages 28 and 30 are arranged inside (below in FIG. 2) original table 1. First carriage 28 has lamp 22 for illuminating original D, reflection plate 24 for focusing illumination light emitted from lamp 22 onto original D, and first mirror 26 for reflecting light reflected by original D toward second carriage 30. First carriage 28 is movable to be parallel to original table 1 by a pulse motor (not shown) through a toothed belt (not shown), and the like. Second carriage 30 has second and third mirrors 32 and 34, arranged to be perpendicular to each other, for reflecting reflection light from original D reflected by the first carriage toward a photosensitive body (to be described later). Second carriage 30 is driven to follow first carriage 28 through the toothed belt (not shown), and the like for driving first carriage 28, and is moved at a speed ½ the moving speed of first carriage 28.

Furthermore, in a plane below first carriage 28, and including the optical axis of light deflected through second carriage 30, focusing lens 36, movable through a driving mechanism (not shown), for converging reflection light from second carriage 30, and focusing the reflection light at a desired magnification by movement of itself, and fourth mirror 38, which deflects the reflection light toward photosensitive body 40 (to be described later) to focus the reflection light at a desired position on photosensitive body 40, and is movable along the optical axis by a driving mechanism (not shown) to correct a variation of a focal length upon movement of lens 36, are arranged. Needless to say, the reflection light corresponds to characters or figures described on original D, i.e., image information on original D.

Photosensitive body 40 on which a distribution pattern of electric charges, i.e., an electrostatic latent image is formed by focusing light guided by fourth mirror 38 is arranged below lens 36, i.e., near the center of the copying machine. Around photosensitive body 40, charging device 42 for charging a predetermined electric charge on photosensitive body 40, developing device 44 for visualizing an electrostatic latent image formed on photosensitive body 40 by utilizing a toner, transfer device 46, integrally having AC voltage application device 46*a* for separating paper sheet P from photosensitive body 40, for transferring a toner image formed on photosensitive body 40 onto a transfer medium, i.e., copy paper sheet P, supplied from a paper supply/discharge section (to be described later), and cleaning device 48 for removing an electric charge distribution on photosensitive body 40 to initialize the charging state of photosensitive body 40, and removing any residual toner are arranged in the order named. Needless to say, since a latent image formed on photosensitive body 40 is converted into a toner image through developing device 44, image information included in original D is copied as a toner image, and the toner image is output onto paper sheet P.

Paper cassettes 50*a* and 50*b* for supplying transfer media, for example, copy paper sheets P, post cards, OHP sheets, and the like, toward photosensitive body 40 are inserted in the right side portion of the copying machine.

Paper discharge tray 52*a* for stocking copied paper sheets P on each of which an image (toner image) formed on photosensitive body 40 is transferred and fixed is arranged on the left side portion of the copying machine, i.e., at a position corresponding to the downstream side of the rotational direction of photosensitive body 40 (the left side portion of the machine main body in FIG. 2; in general, copy paper sheet P is supplied from one end of the copying machine, and is discharged to the other opposing end).

In the copying machine, and between photosensitive body 40 and paper cassettes 50*a* and 50*b*, first and second pick-up rollers 51*a* and 51*b* for respectively picking up paper sheets P from cassettes 50*a* and 50*b* one by one, first and second feed rollers 53*a* and 53*b*, each including a pair of rollers, for feeding paper sheet P toward photosensitive body 40, feeding paths 54*a* and 54*b*, each formed by a pair of guide plates, for feeding paper sheet P from feed rollers 53*a* and 53*b* toward photosensitive body 40, and a pair of timing rollers 55 for correcting the inclination of paper sheet P, registering the leading end of an image formed on the photosensitive body with the leading end of paper sheet P, and feeding paper sheet P at the same speed as the rotational speed of photosensitive body 40 are arranged.

In addition, the copying machine comprises, between photosensitive body 40 and paper discharge tray 52*a*, feed device 56 for feeding paper sheet P on which a toner image formed on photosensitive body 40 is transferred, and the toner is electrostatically attached, fixing device 58 for melting and fixing the toner transferred onto paper sheet P, and a pair of paper discharge rollers 52 for discharging paper sheet P, on which the toner image is fixed, outside the machine.

Figure 3:
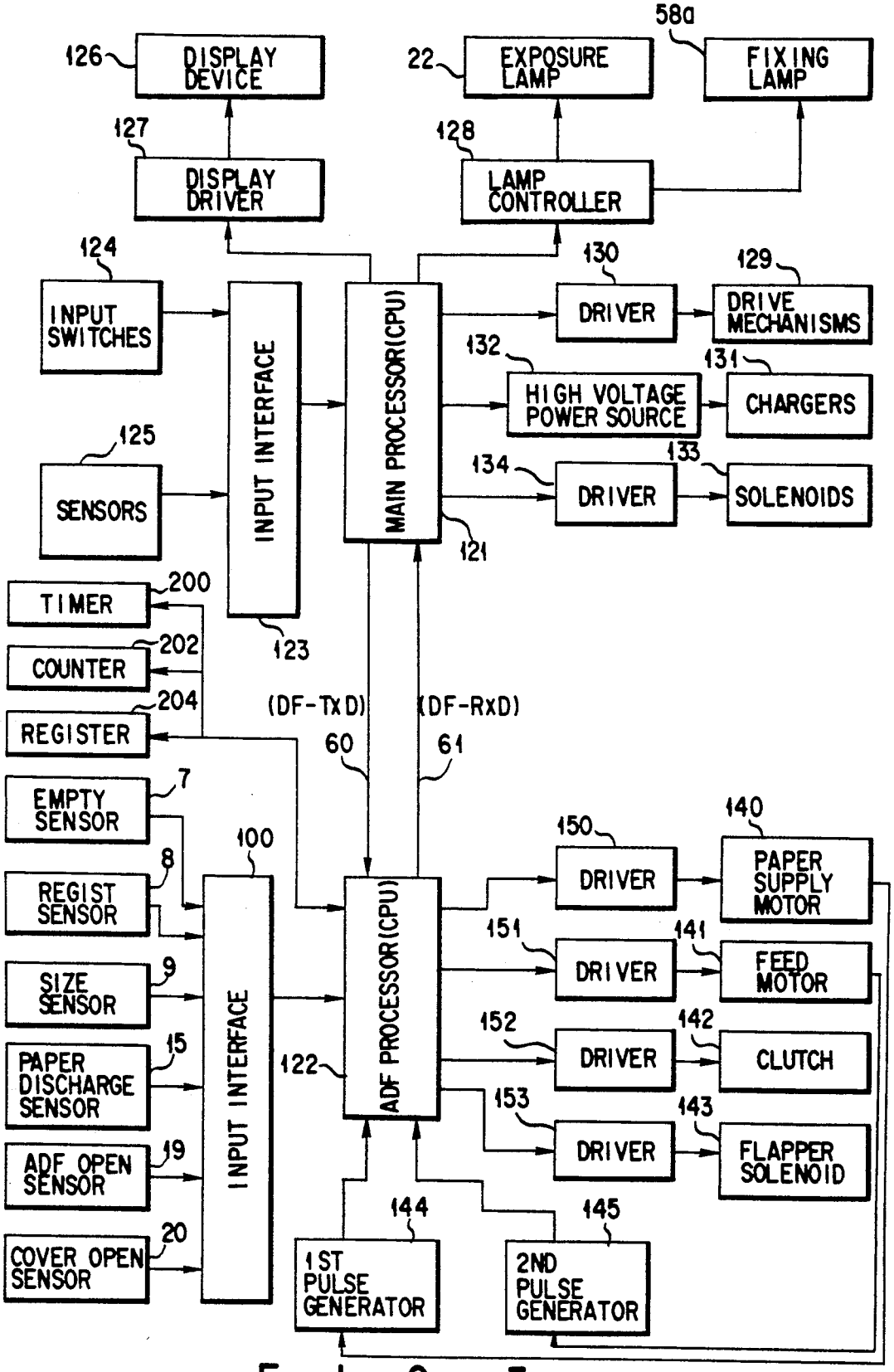
FIG. 3 is a block diagram showing the overall control system of the electronic copying machine and the auto document feeder.

FIG. 3 is a block diagram showing the overall control system of the auto document feeder with the above arrangement, and the electronic copying machine, which mounts the auto document feeder. Reference numeral 121 denotes a main processor for mainly controlling the electronic copying machine main body; and 122, an ADF processor for mainly controlling the auto document feeder. Main processor 121 and ADF processor 122 exchange various interface signals (to be described in detail later) with each other.

Main processor 121 is connected to input switches 124 including various keys on an operation panel (not shown), various sensors (switches, sensors, and the like) 125 necessary for other control operations, and the like through input interface 123 such as a data selector. Main processor 121 is also connected to driver 127 for driving display device 126 including various displays on the operation panel, lamp controller 128 for controlling exposure lamp 22, fixing lamp 58*a*, and the like driver 130 for driving drive mechanisms (a main motor, a clutch, and the like) 129, high voltage power source 132 for driving various chargers 131, driver 134 for driving various solenoids 133, and the like.

ADF processor 122 is connected, through input interface 100, empty sensor 7, regist sensor 8, size sensor 9, paper discharge sensor 15, ADF open sensor 19, cover open sensor 20, and the like.

ADF processor 122 is also connected to drivers 150, 151, 152, and 153 for respectively driving paper supply motor 140 for driving pick-up roller 3 and separation roller 4, feed motor 141 for driving conveyor belt 12, aligning roller pair 6, reverse roller group 14, paper discharge roller 17, and the like in the feed section, clutch 142 for transmitting a drive force from feed motor 141 to aligning roller pair 6, and flapper solenoid 143 for driving flapper 16. Furthermore, ADF processor 122 is connected to first pulse generator 144, second pulse generator 145, timer 200, counter 202, and register 204. First pulse generator 144 includes a rotary encoder attached to paper supply motor 140, and generates clock pulses from the encoder. Second pulse generator 145 includes a rotary encoder attached to feed motor 141, and generates clock pulses from the encoder.

Interface signals exchanged between main processor 121 and ADF processor 122 will be described below.

The interface signals are exchanged between main processor 121 and ADF processor 122 by an asynchronous serial communication method. Interface signals 60 to be transmitted from main processor 121 to ADF processor 122 are included in a control signal group (DF-TxD) to be transmitted from the main processor to the ADF processor, and interface signals 61 to be transmitted from ADF processor 122 to main processor 121 are included in a status signal group (DF-RxD) from the ADF processor.

Interface signals 60 from main processor 121 to ADF processor 122 include 7 signals, i.e., a double/single-side selection signal (ORG-ROTH) for setting a double-sided original feed mode or a single-sided original feed mode, an original supply signal (ORG-IN) to be output to start an original replace operation, an original discharge signal (ORG-OUT) to be output to discharge an original on the feeding path, a mode signal (MODE) to be output to inform whether the auto document feeder is set in a normal original feed mode or a test mode, a test code signal (TEST) to be output to transmit a coded signal so as to start various test operations when the auto document feeder is in the test mode, an adjustment code signal (ADJUST) to be output to adjust the feed amount of an original to be fed when the auto document feeder is in the normal original feed mode, and an aging signal (AGING) to be output to cause the auto document feeder to perform an operation at the same timing as in the original feed mode without originals.

Interface signals 61 from ADF processor 122 to main processor 121 include 10 signals, i.e., an original set signal (ORG-RDY) indicating whether or not original D is set on paper supply tray 2, a jam signal (DF-JAM) indicating a jam state, an error signal (DF-ERR) indicating that an operation error has occurred in paper supply motor 140 or feed motor 141 in the auto document feeder, an error code signal (ERR-COD) for, when the error signal (DF-ERR) or jam signal (DF-JAM) is output, coding the error or jam content, and supplying it to the copying machine main body, a DF active signal (DF-ACT) to be output during an interval from the beginning of the original replace operation to the end of original size detection by the auto document feeder, an original stop signal (ORG-STP) indicating that an original is set at an exposure position, a DF open signal (DF-OPN) indicating an open/closed state of the open/close cover of the feed section or the paper supply section of the auto document feeder, an original size signal (SIZE0, SIZEl, SIZE2, SIZE3) indicating an original size as a 4-bit code, an original face signal (ORG-FACE) indicating whether an original is set at the exposure position with the first surface facing down or the second surface facing down in a double-sided original feed operation, and a presupply signal (PRE-FED) indicating whether or not an original is present at a presupply position.

Figure 4:
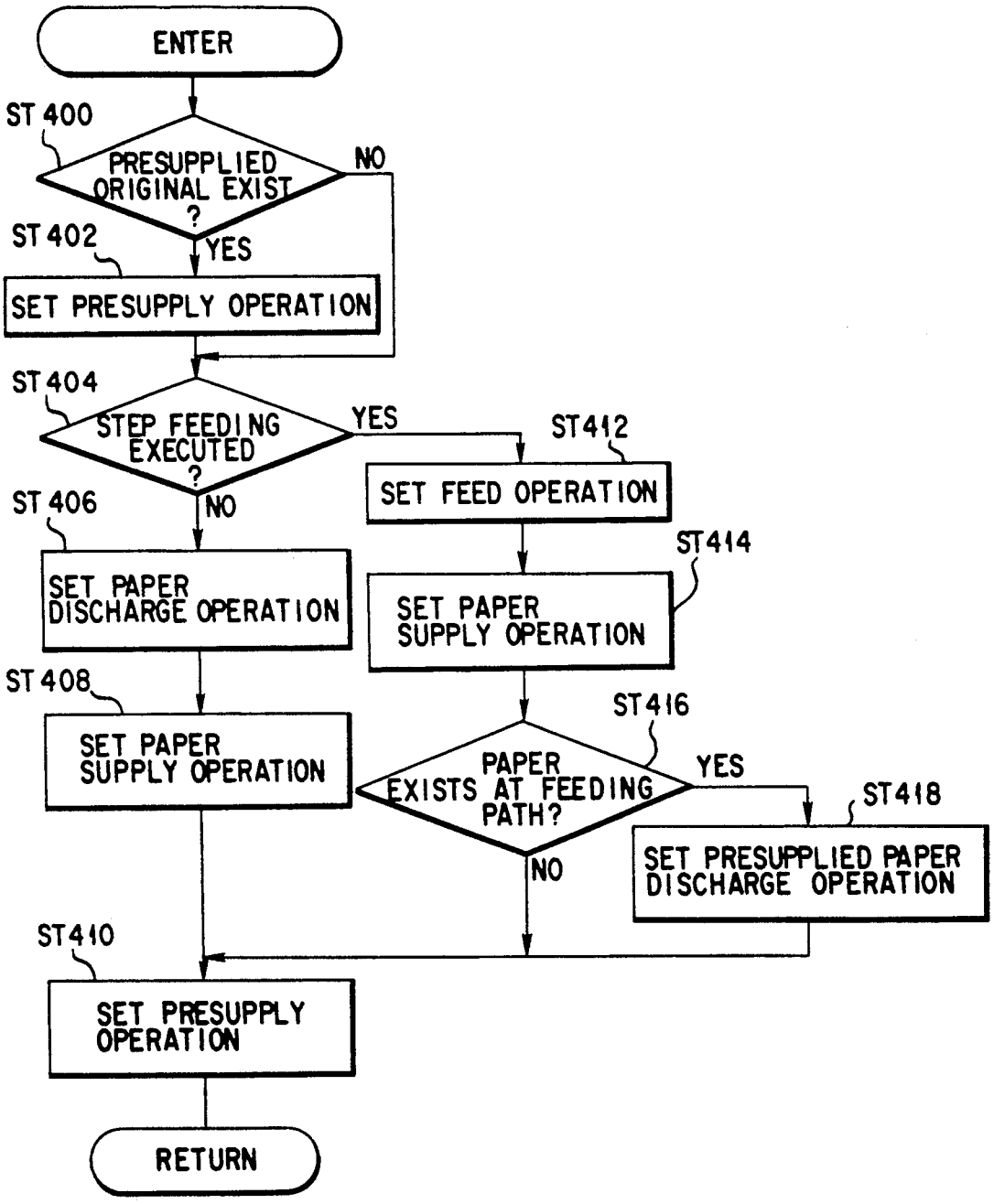
FIG. 4 is a flow chart for explaining paper supply operation control.

FIG. 4 is a flow chart for explaining an original supply control operation of the system shown in FIGS. 1 to 3.

When one of originals D on paper supply tray 2 (FIG. 1) is not presupplied to paper supply section S (YES in ST400), ADF processor 122 (FIG. 3) sets a presupply operation (ST402). Thus, one of originals D is presupplied to paper supply section S.

When a step feed operation is not performed (NO in ST404), processor 122 sets a paper discharge operation (ST406), and then sets a paper supply operation (ST408). Thereafter, the presupply operation is set (ST410).

When a step feed operation is performed (YES in ST404), processor 122 sets a feed operation (ST412), and then sets the paper supply operation (ST414). Thereafter, if a sheet is present on an original feeding path (feed section T) (YES in ST416), a presupplied paper discharge operation is set (ST418), and then, the presupply operation is set (ST410). If no sheet is present on the original convey path (NO in ST416), the flow skips the presupplied paper discharge operation.

Figure 5A:
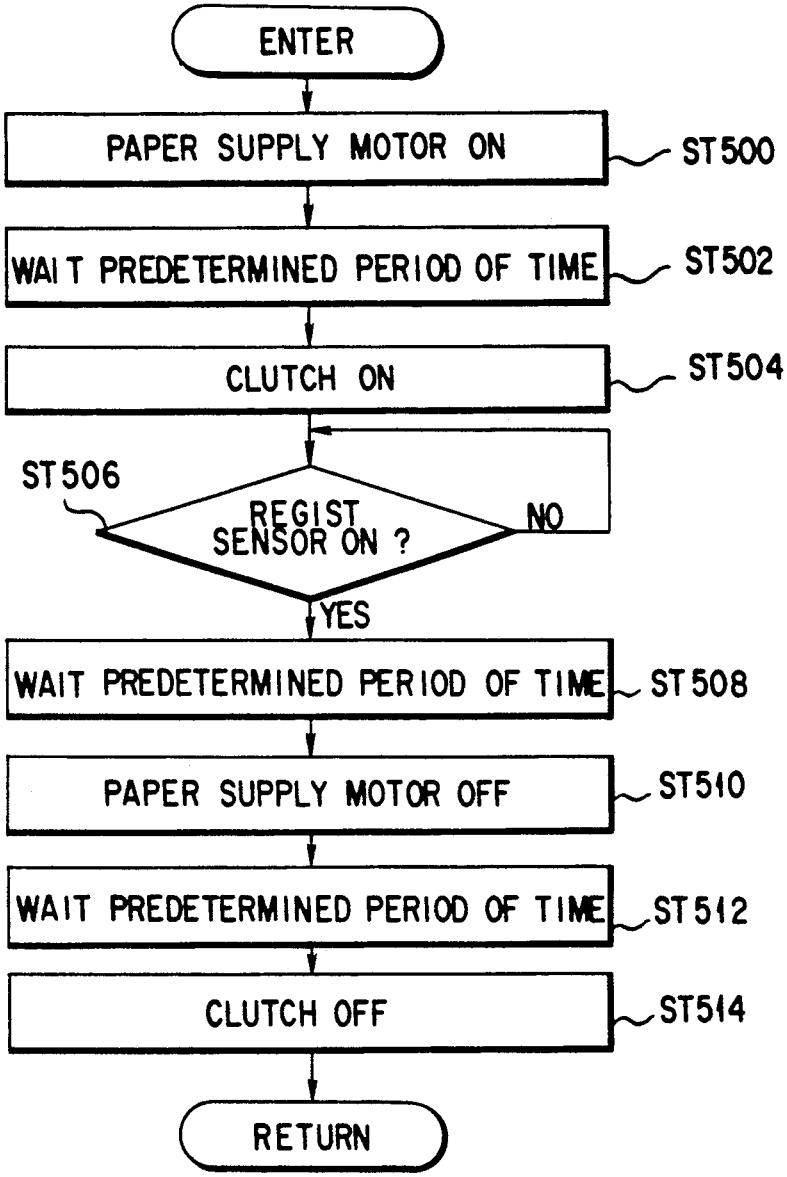
FIG. 5A is a flow chart for explaining a presupply operation.

FIG. 5A is a flow chart for explaining an original presupply operation (ST402, ST410) in FIG. 4.

In this presupply operation mode, paper supply motor 140 (FIG. 3) is enabled or rendered ON (its drive operation is started) (ST500). From this ON timing, processor 122 (FIG. 3) checks an elapse of a predetermined period of time using timer 200 (ST502). After the elapse of the predetermined period of time (time delay), clutch 142 (FIG. 3) is enabled or rendered ON (ST504). If it is determined that regist sensor 8 (FIG. 3) is 0N (YES in ST506), processor 122 checks an elapse of a predetermined period of time from this ON timing (ST508), and turns off paper supply motor 140 (ST510). After an elapse of another predetermined period of time after the motor OFF operation (ST512), clutch 142 is disabled or rendered OFF (ST514).

Of the above-mentioned processing, during an interval between the ON and OFF timings of paper supply motor 140 (ST500 to ST510), the original presupply operation is performed.

Figure 5B:
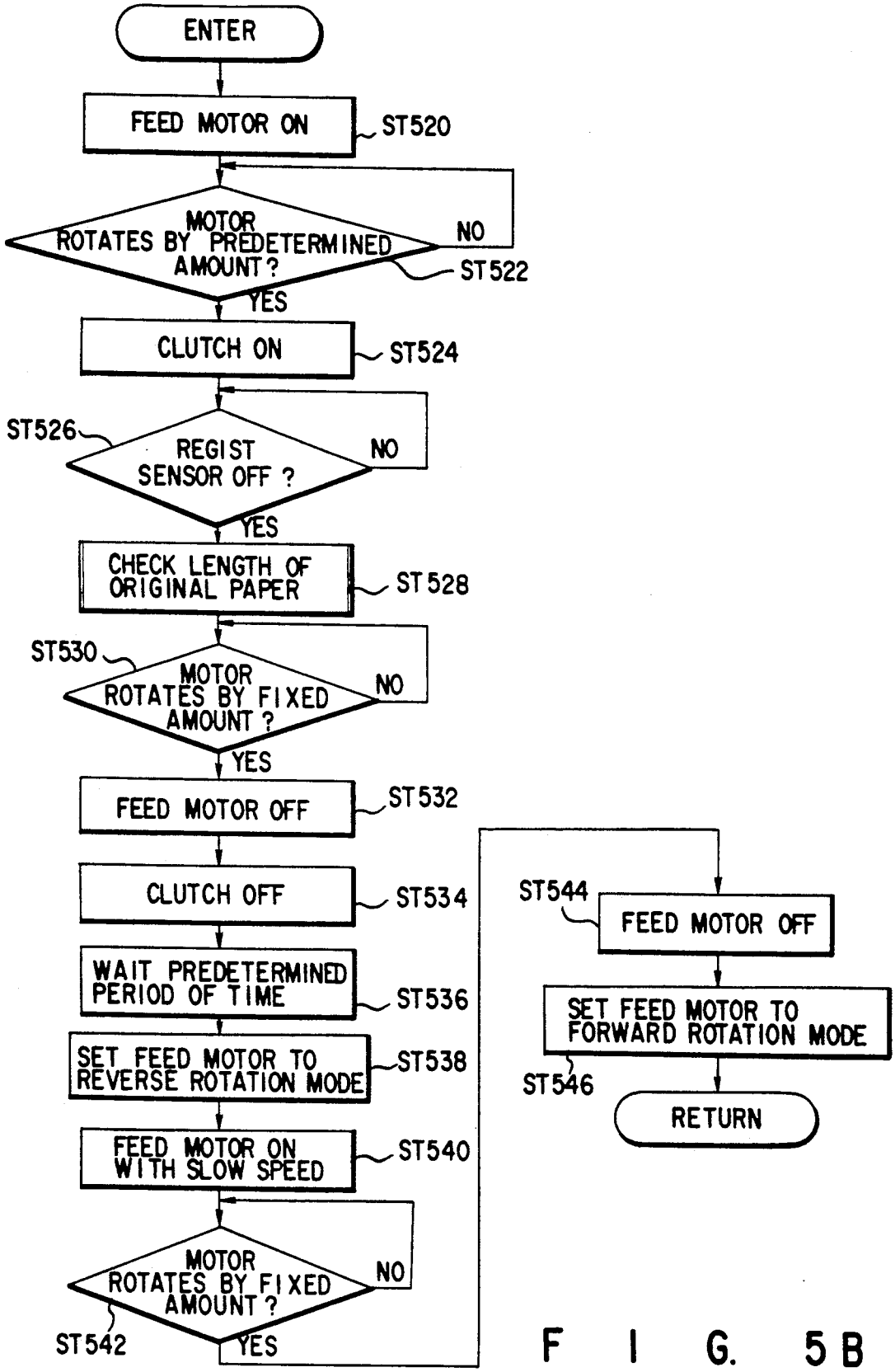
FIG. 5B is a flow chart for explaining a paper supply operation.

FIG. 5B is a flow chart for explaining an original paper supply operation (ST408, ST414) in FIG. 4.

In the paper supply operation mode, feed motor 141 (FIG. 3) is rendered ON (ST520). When the amount of rotation of ONed motor 141 reaches a predetermined value (YES in ST522), clutch 142 is rendered ON (ST524). If it is determined that resist sensor 8 is OFF (YES in ST526), the length of an original fed at that time is checked (ST528). This checking operation can be attained by counting pulses output from second pulse generator 145 (FIG. 3) by counter 202.

When feed motor 141 completes a predetermined amount of rotation according to the checked original length (YES in ST530), feed motor 141 is rendered OFF (ST532), and subsequently, clutch 142 is also rendered OFF (ST534). After an elapse of a predetermined period of time from the OFF timing of the clutch (ST536), processor 122 sets feed motor 141 in a reverse rotation mode (ST538), and the operation of motor 141 is started at a low speed (ST540).

When feed motor 141 rotated in the reverse direction at a low speed completes a predetermined amount of rotation (YES in ST542), feed motor 141 is rendered OFF (ST544), and then, processor 122 resets feed motor 141 to a forward rotation mode (ST546).

Of the above-mentioned processing, during an interval between the ON and OFF timings of feed motor 141 (ST520 to ST544), the original supply operation is performed.

Figure 6A:
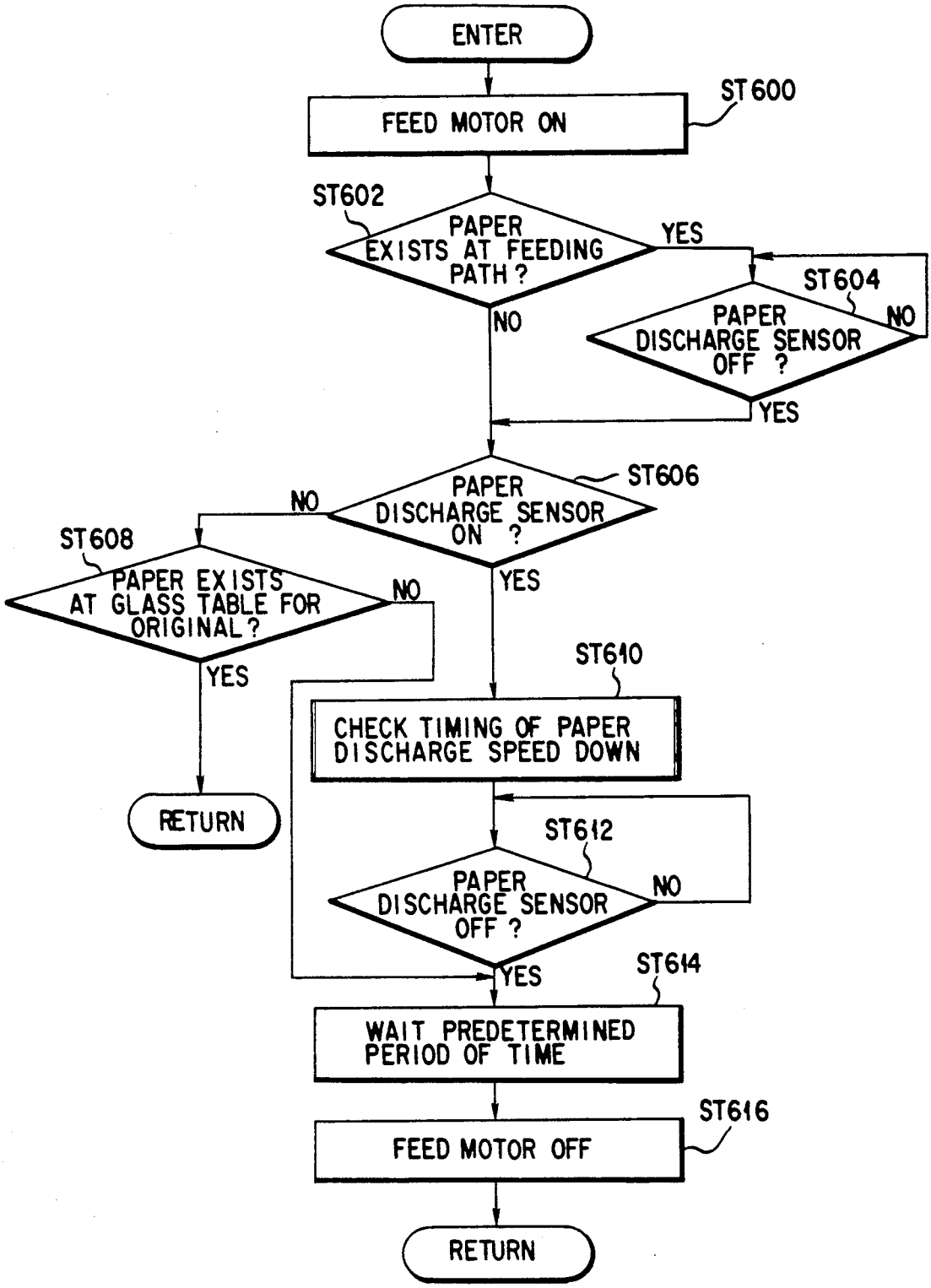
FIG. 6A is a flow chart for explaining a paper discharge operation.

FIG. 6A is a flow chart for explaining an original paper discharge operation (ST406) in FIG. 4.

In the paper discharge operation mode, feed motor 141 (FIG. 3) is rendered ON (ST600). Thereafter, if no sheet is present on the original feeding path (feed section T) (NO in ST602), or even if a sheet is present on the original feeding path (YES in ST602), if paper discharge sensor 15 is OFF (YES in ST604), and subsequently, if paper discharge sensor 15 is turned 0N (YES in ST606), the deceleration timing of the original discharge operation is checked (ST610). The timing checking operation is performed based on the count value of pulses from pulse generator 145, and the physical dimensions of the respective mechanism sections shown in FIG. 1.

After the timing is checked, if paper discharge sensor 15 is OFF (YES in ST612), processor 122 checks an elapse of a predetermined period of time from this OFF timing (ST614), and turns feed motor 141 OFF (ST616).

Of the above-mentioned processing, during an interval between the ON and OFF timings of feed motor 141 (ST600 to ST616), the original discharge operation is performed.

If it is determined in step ST606 that paper discharge sensor 15 is OFF (NO in ST606), and if a sheet (original) is present on a glass plate of original table 1 (FIG. 2) (YES in ST608), the processing in FIG. 6A is completed. If no sheet is present on the glass plate of original table 1 (NO in ST608), the flow skips steps ST610 to ST612.

Figure 6B:
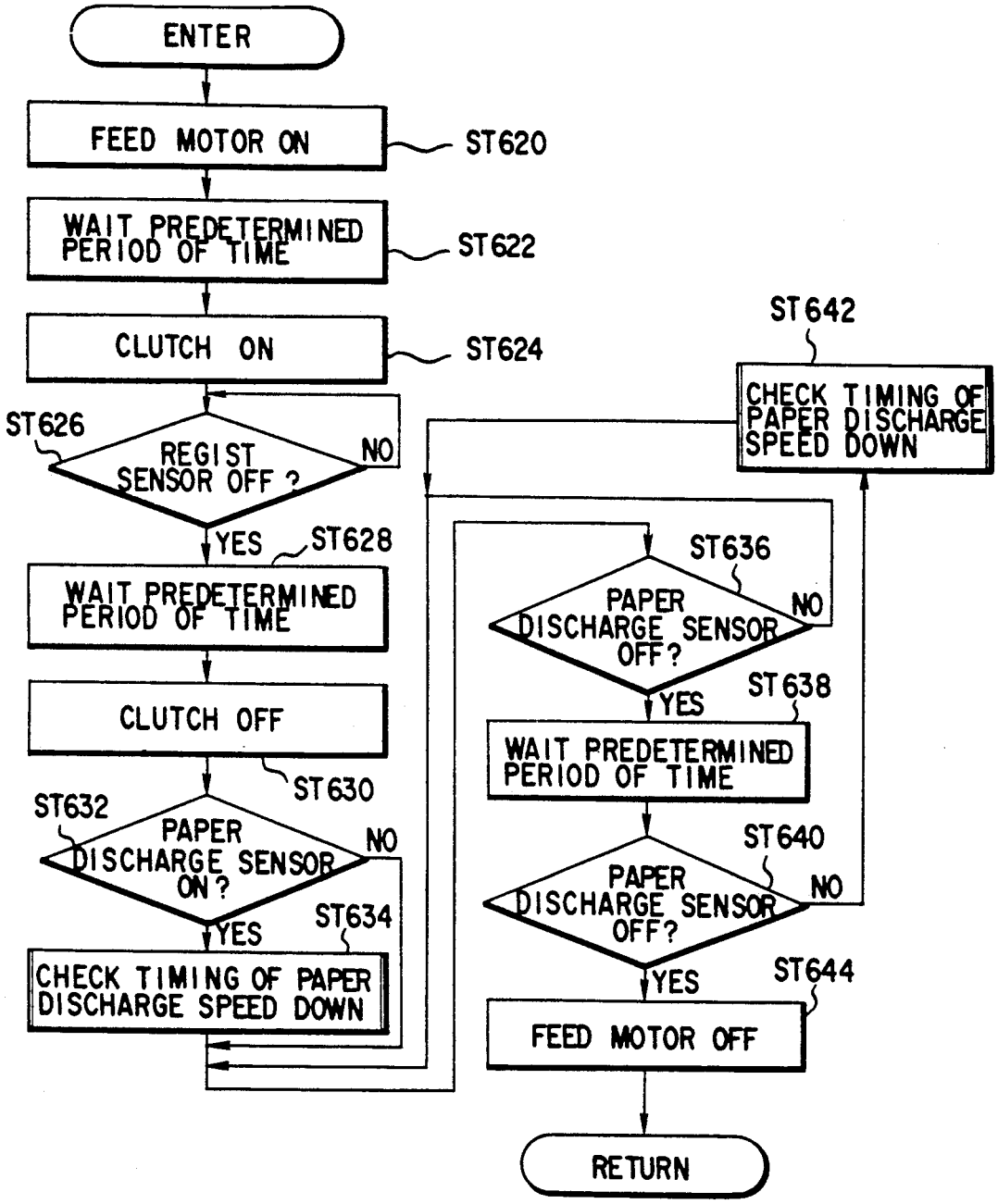
FIG. 6B is a flow chart for explaining a presupplied paper discharge operation.

FIG. 6B is a flow chart for explaining the presupplied original discharge operation (ST418) in FIG. 4.

In this presupplied paper discharge operation mode, feed motor 141 (FIG. 3) is rendered ON (ST620). After an elapse of a predetermined period of time after the 0N timing of the motor (ST622), clutch 142 is rendered 0N (ST624). If it is determined that regist sensor 8 is OFF (YES in ST626), clutch 142 is rendered OFF (ST630) after an elapse of a predetermined period of time (ST628).

Thereafter, if paper discharge sensor 15 is turned ON (YES in ST632), the deceleration timing of the original discharge operation is checked (ST634). After the timing is checked, if it is determined that paper discharge sensor 15 is OFF (YES in ST636), processor 122 checks an elapse of a predetermined period of time from this OFF timing (ST638). If it is determined, even after the elapse of the predetermined period of time, that paper discharge sensor 15 is OFF (YES in ST640), feed motor 141 is rendered OFF (ST644).

If it is determined, after the elapse of the predetermined period of time, that paper discharge sensor 15 is ON (NO in ST640), the deceleration timing of the original discharge operation is checked (ST642), and the processing routine returns to step ST636.

Of the above-mentioned processing, during an interval between the ON and OFF timings of feed motor 141 (ST620 to ST644), the presupplied original discharge operation is performed.

Figure 7:
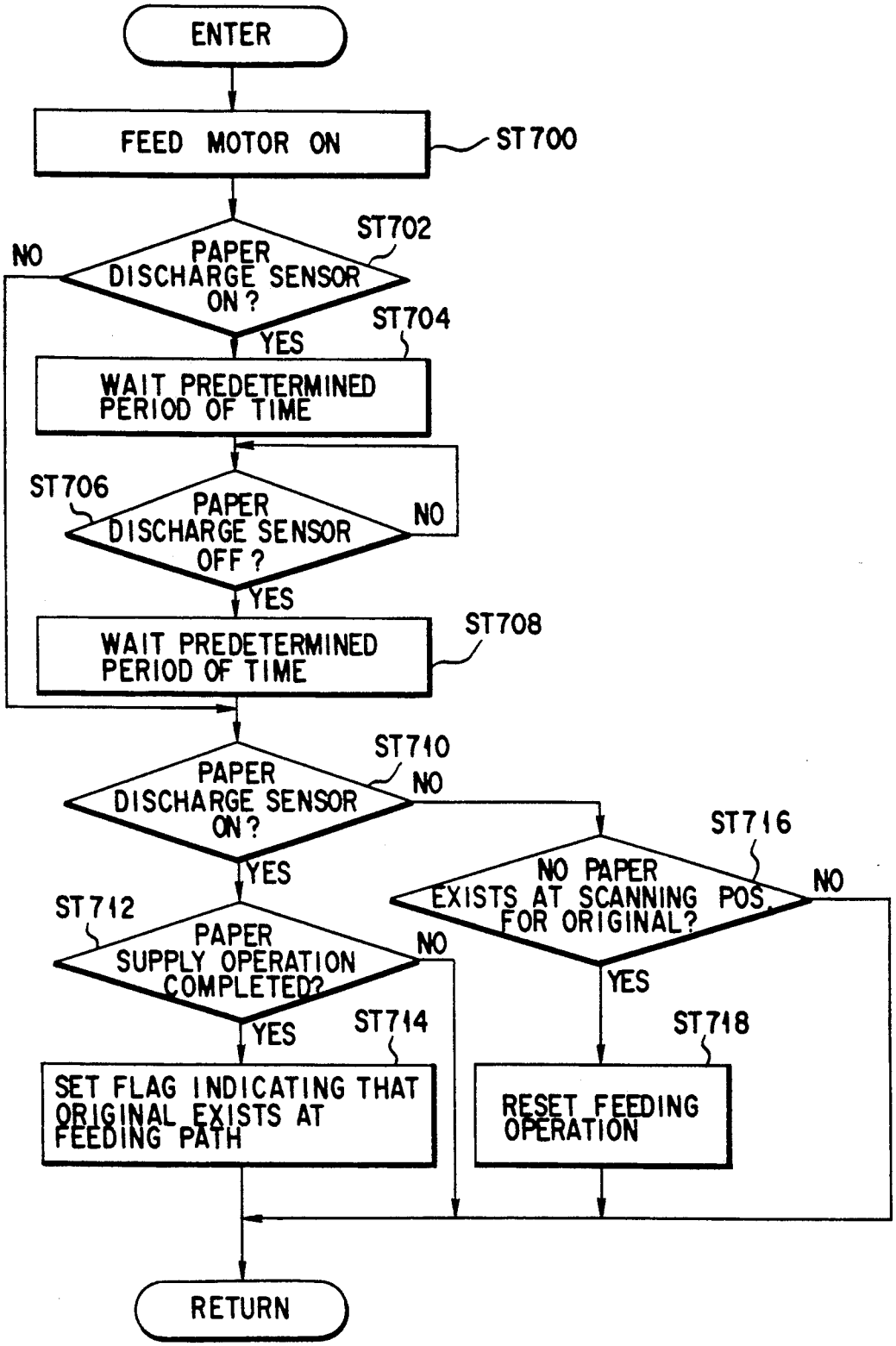
FIG. 7 is a flow chart for explaining a feed operation.

FIG. 7 is a flow chart for explaining the original feed operation (ST412) in FIG. 4.

In this feed operation mode, feed motor 141 (FIG. 3) is rendered ON (ST700). Subsequently, if paper discharge sensor 15 is turned ON (YES in ST702), processor 122 checks an elapse of a predetermined period of time from this ON timing (ST704). If it is determined, after the elapse of the predetermined period of time, that paper discharge sensor 15 is turned OFF (YES in ST706), the elapse of a predetermined period of time from this OFF timing is checked (ST708). If it is determined in step ST702 that paper discharge sensor 15 is OFF (NO in ST702), the flow skips steps ST704 to ST708.

Thereafter, if paper discharge sensor 15 is turned ON (YES in ST710), and the paper supply operation shown in FIG. 5B is completed (YES in ST712), a flag of register 204 (FIG. 3) is set (ST714). When this flag is set, processor 122 can detect that original D is present on the original feeding path (T) of the feeder shown in FIG. 1.

If it is determined in step ST710 that paper discharge sensor 15 is OFF (NO in ST710), and if no sheet (original) is present at a copy position of original table 1 of the feeder shown in FIG. 1 (YES in ST716), the feed operation shown in FIG. 7 is reset (ST718).

The mechanical operations of the system with the arrangement shown in FIGS. 1 to 3 will be described below. FIGS. 9A to 9I show single-sided original feed processes in a step feed mode, Figs. lOA to 10F show single-sided original feed processes while the step feed mode is disabled, and FIGS. 11A to 11I show double-sided original feed processes. Note that in FIGS. 9A to 11I, (1) indicates the first original; (2), the second original; (3), the third original; and A to I, feed processes.

When a power switch (not shown) is turned ON, the copying machine main body is set in a ready state (copy enabled state) after an elapse of a predetermined period of time from the ON operation of the power switch. At this time, main processor 121 is ready to accept a copy key arranged on the operation panel, and main processor 121 and ADF processor 122 are ready to exchange interface signals 60 and 61 with each other.

A single-sided original feed operation in this state will be described below with reference to FIGS. 1 and 3 and FIGS. 9A to 10F.

Figure 9A:
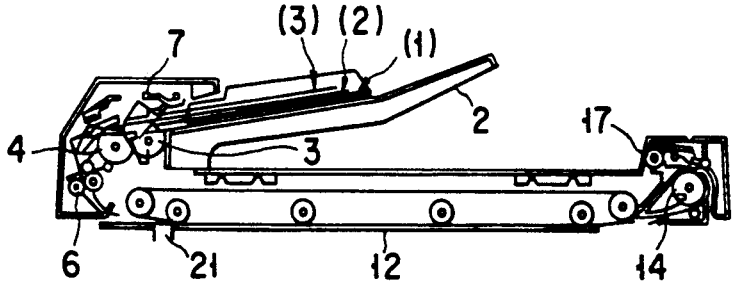
FIGS. 9A to 9I are explanatory views sequentially showing original feed processes (steps A to I) when a single-sided original is fed in a step feed mode.

When original D is set on paper supply tray 2, empty sensor 7 is turned ON, and detects the presence of the original (see FIG. 9A). More specifically, the presence/absence of an original on tray 2 can be detected by sensor 7. ADF processor 122 (FIG. 3) outputs signal ORG-RDY to main processor 121. When the copy key is turned ON, main processor 121 outputs signal ORG-IN.

Upon reception of signal ORG-IN, ADF processor 122 enables signal DF-ACT, and disables signal ORG-STP, thus starting the original feed operation of the auto document feeder.

More specifically, processor 122 enables paper supply motor 140 (FIG. 3) to drive pick-up roller 3 and separation roller 4 in FIG. 9A, thereby picking up the lowermost one of a stack of originals D set on paper supply tray 2, and feeding the picked-up original to aligning roller pair 6. After an elapse of a predetermined period of time from when the leading end of fed original D turns on regist sensor 8 (FIG. 1), processor 122 stops paper supply motor 140, and registers original D by aligning roller pair 6 (see FIG. 9B).

Figure 9B:
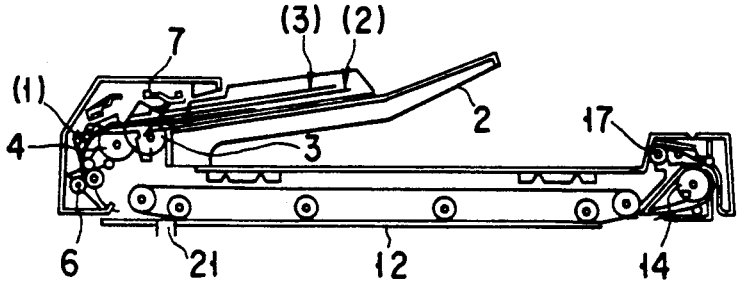
Figure 9C:
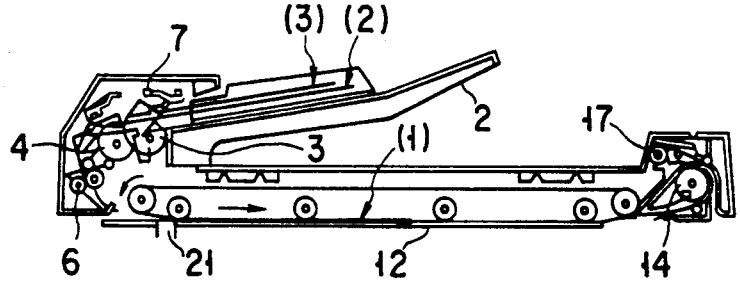

Processor 122 rotates feed motor 141 (FIG. 3) in the forward direction to rotate conveyor belt 12, reverse roller group 14, and paper discharge roller 17 in FIG. 9B in a paper discharge direction, thus performing an original discharge operation. This operation is performed when originals remain on original table 1. Upon completion of discharge operations of remaining originals, processor 122 enables clutch 142 (FIG. 3) to feed original D fed to aligning roller pair 6 in FIG. 9B to conveyor belt 12.

When original D passes size sensor 9 for detecting the original width in a direction perpendicular to the original feed direction, and the trailing end of original D passes regist sensor 8 (FIG. 1), signals SIZE0 to SIZE3 are set, and signal DF-ACT is enabled. From this signal set timing, pulses from second pulse generator 145 (FIG. 3) are counted by counter 202, thereby detecting the feed amount of original D. When original D is fed to a position where its trailing end exceeds the left end of original stopper 21 by a predetermined amount, the number of pulses corresponding to this feed amount is counted by counter 202. Processor 122 stops feed motor 141, and after an elapse of a predetermined period of time since the motor is stopped, feed motor 141 is rotated in the reverse direction. Then, original D abuts against the left end of original stopper 21 (FIG. 1), thus ending the feed operation of first original D (see FIGS. 9C and 9D). The original position at this time corresponds to an image scanning position of the original. This position can be detected based on the ON/OFF timings of sensors 8 and 9, and the count value of pulses from pulse generator 145.

Signal ORG-STP is output to main processor 121 a predetermined period of time before the end of the feed operation. This is to shorten a time required for an original scanning system (first carriage 28) to be moved from an operation start point to an original scanning point when the original scanning system (first carriage 28) of the copying machine starts its operation in response to the output of signal ORG-STP.

Upon completion of the feed operation of first original D, the original scanning system (first carriage 28) of the electronic copying machine scans original D, as described above. During this interval, the auto document feeder performs the presupply operation for feeding second original D to the position of aligning roller pair 6 under the same control as the first original feed operation, so that second original D stands by at a presupply position closer to an exposure position (see FIG. 9E).

Upon completion of scanning of first original D, main processor 121 outputs signal ORG-IN to ADF processor 122. Upon reception of signal ORG-IN, ADF processor 122 starts the feed operation of second original D from the presupply position. At this time, when the size of first original D is shorter than a predetermined length in the feed direction, a step feed operation is performed (see FIG. 9F). This size is detected by size sensor 9 in FIG. 1.

In this specification, the step feed operation means an operation for, when original D fed to the exposure position (image scanning position) is replaced with the next original D, feeding original D fed to the exposure position to a step position (intermediate position) where the leading end of the original reaches paper discharge sensor 15 between the exposure position and paper discharge tray 18 (FIG. 1) without discharging it onto paper discharge tray 18, and causing original D to stand by at that position. More specifically, the step position can be detected by sensor 15.

Note that the step feed operation can be executed independently of original sizes if the appearance (an aligning state of a stack of copied paper sheets P discharged onto tray 18) is disregarded.

With this step feed operation, when original D at the exposure position reaches the step position before a paper discharge enabled position to paper discharge tray 18, the feed operation of next original D to be fed to the exposure position can be started. For this reason, the original replace time can be shortened.

Whether or not original D is discharged on tray 18 can be detected by checking, after sensor 15 detects the leading end of the original, whether or not the number of pulses from pulse generator 145 exceeds a predetermined value.

Figure 9D:
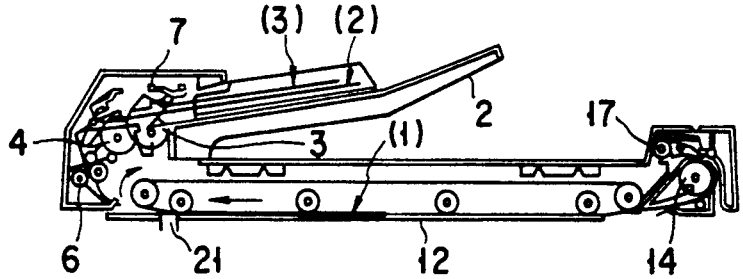
Figure 9E:
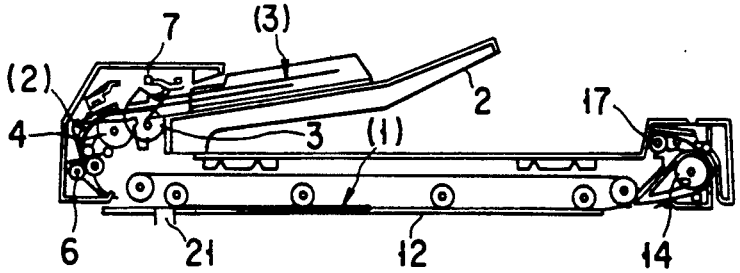

When second original D is fed to a position where its trailing end exceeds the left end of original stopper 21 by a predetermined amount, and this feed amount is counted by counter 202, processor 122 stops feed motor 141 in the same manner as in FIG. 9D. After an elapse of a predetermined period of time since the motor is stopped, processor 122 rotates feed motor 141 in the reverse direction, thus causing original D to abut against the left end of original stopper 21, and ending the feed operation of second original D (FIG. 9G). Then, third original D is fed to the presupply position (FIG. 9H).

Figure 9F:
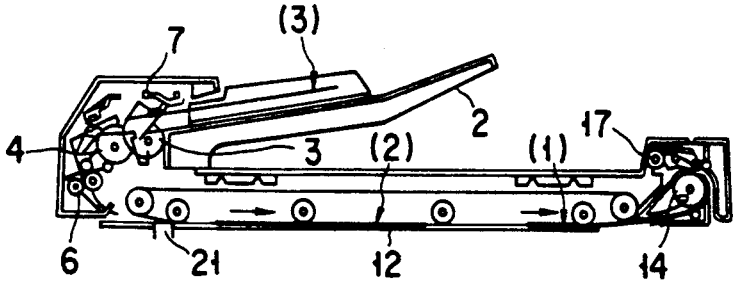
Figure 9G:
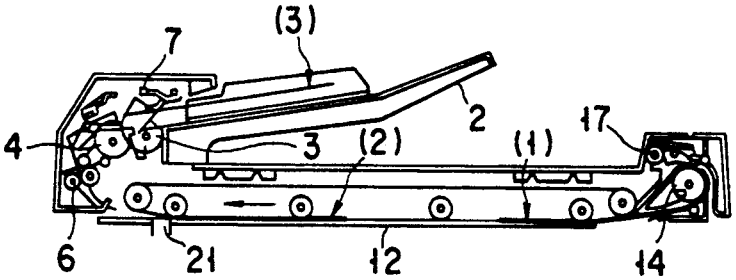
Figure 9H:
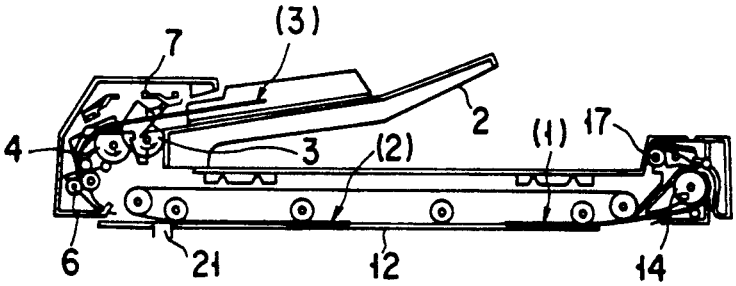
Figure 9I:
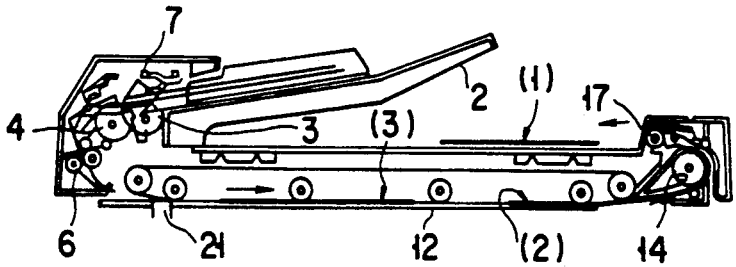

Upon completion of scanning of second original D, the feed operation of third original D from the presupply position is started in the same manner as in FIG. 9F. At this time, when the size of second original D is shorter than the predetermined length, processor 122 performs the step feed operation. At this time, an operation for discharging exposed first original D onto paper discharge tray 18 is simultaneously performed (FIG. 9I).

Thereafter, the original feed processes shown in FIGS. 9D to 9I are sequentially repeated.

When the size of first original D is longer than the predetermined length in the feed direction, the original feed operation is performed according to processes shown in FIGS. 10A to 10F. More specifically, the step feed operation is not performed, and processor 122 enables clutch 142 (FIG. 3) when original D at the exposure position is fed to the paper discharge enabled position to paper discharge tray 18. Processor 122 drives aligning roller pair 6 to feed original D standing by at the presupply position (see FIG. 10B) to the exposure position (see FIGS. 10C and 10D).

Figure 10A:
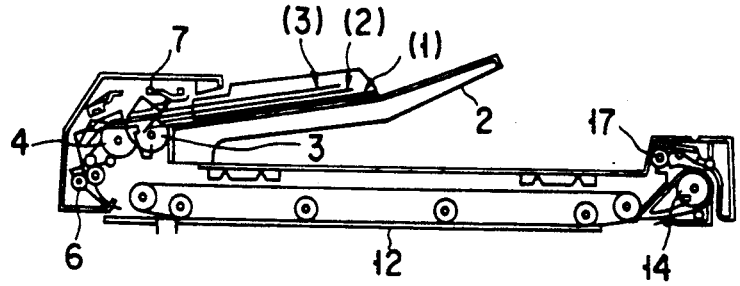
FIGS. 10A to 10F are explanatory views sequentially showing original feed processes (steps A to F) when a single-sided original is fed while disabling the step feed mode.
Figure 10B:
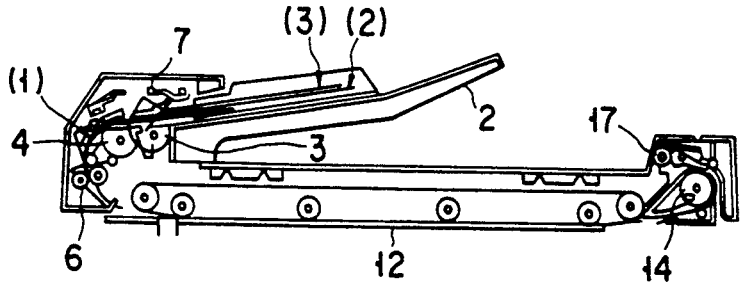
Figure 10C:
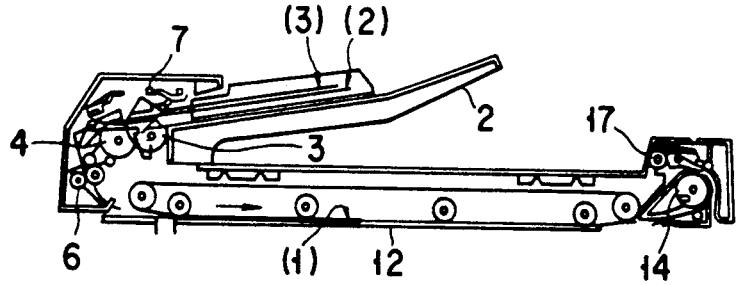
Figure 10D:
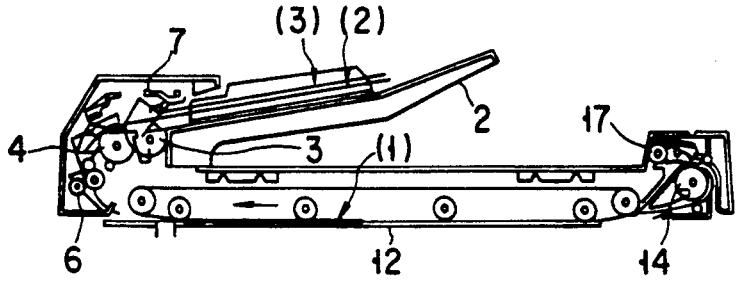
Figure 10E:
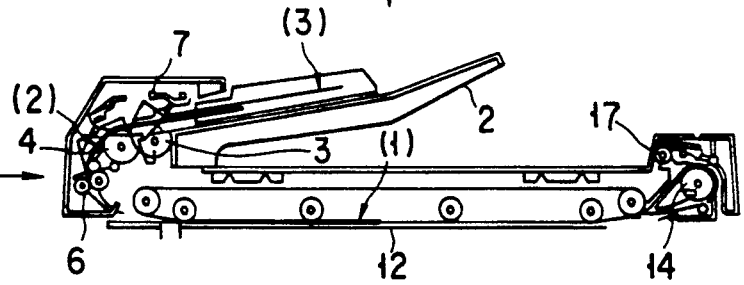
Figure 10F:
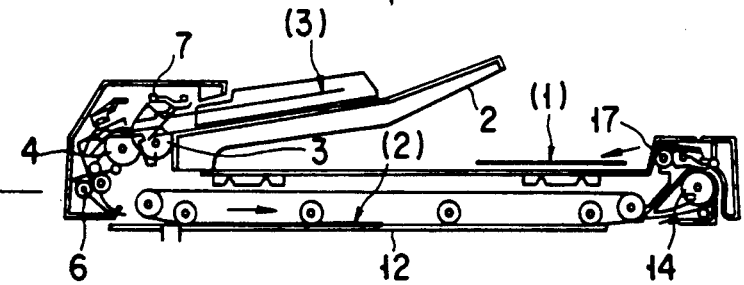

When the step feed operation is not performed, a plurality of originals are fed by repeating processes shown in FIGS. 10E to 10F.

In the single-sided original feed operation "without the step feed operation" shown in FIGS. 10A to 10F, in an original replace operation after the feed operation of second original D to the exposure position, an operation for discharging exposed original D onto paper discharge tray 18 is simultaneously performed (see FIG. 10F).

In the discharge operation in the original replace operation (both with and without the step feed operation), when original D is fed across a distance (a distance across which the leading end of original D to be discharged is discharged to paper discharge tray 18 by a predetermined distance) determined by a distance from the size position of original D at the step position or exposure position to paper discharge roller 17, or a distance from the exposure position to paper discharge roller 17, processor 122 makes control to decrease the rotational speed of feed motor 141 so as to decrease the feed speed of original D to be discharged, so that discharged original D is aligned on paper discharge tray 18.

The above-mentioned original replace operation is performed for a series of originals D. When no original is present on paper supply tray 2, empty sensor 7 is turned OFF, and ADF processor 122 disables signal ORG-RDY. Upon reception of disabled signal ORG-RDY, main processor 121 outputs signal ORG-OUT to discharge original D present midway along the feeding path onto paper discharge tray 18.

Figure 8:
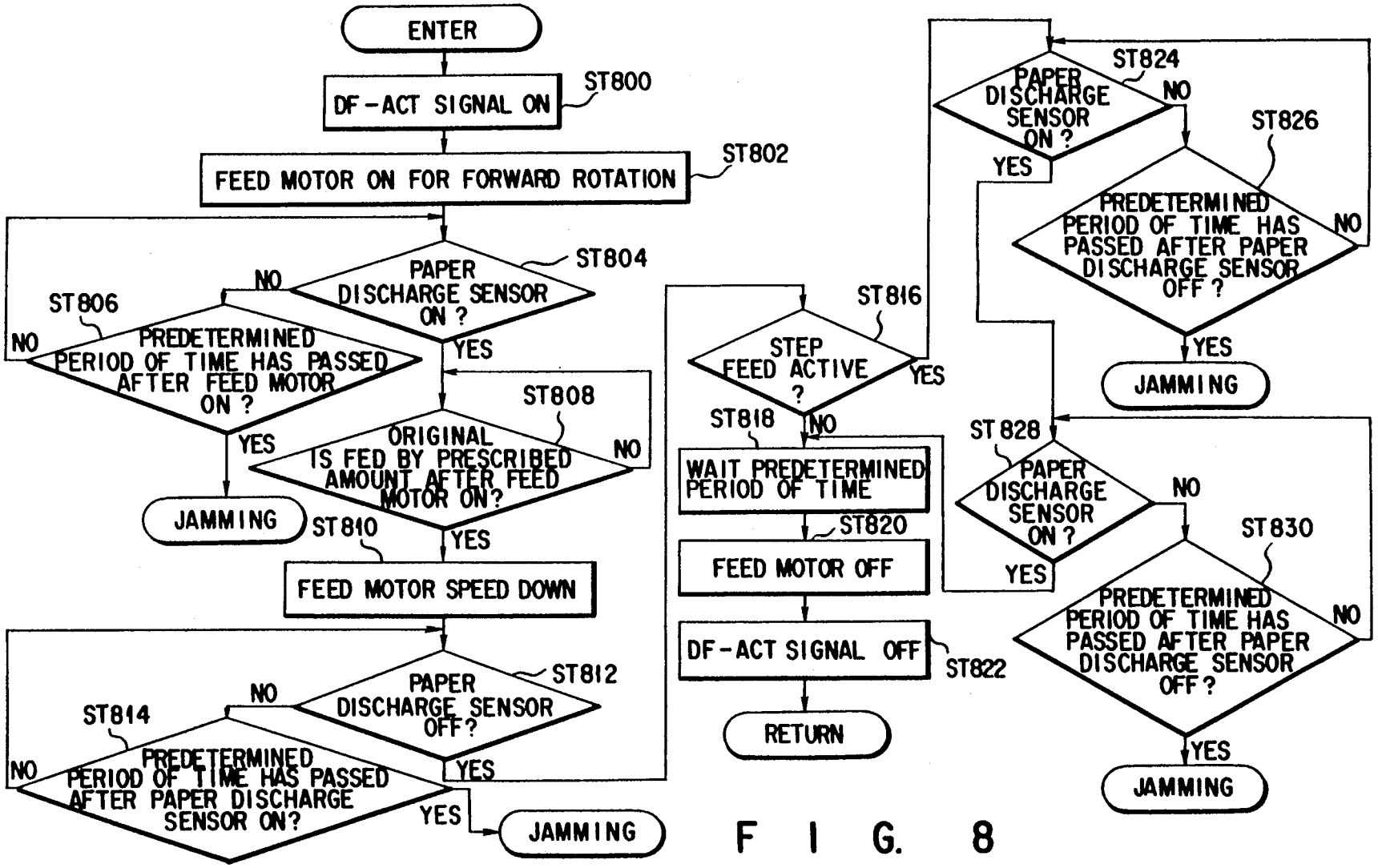
FIG. 8 is a flow chart for explaining details of the paper discharge operation.

Upon reception of signal ORG-OUT, when the original replace operation is performed in the step feed operation mode, ADF processor 122 performs the discharge operation of two originals D, i.e., an original at the step position and the last original at the exposure position. Control of this paper discharge operation is performed as follows (see FIG. 8).

Signal DF-ACT is enabled (ST800), and feed motor 141 is rotated in the forward direction (ST802). Under a condition that paper discharge sensor 15 is ON (YES in ST804), when original D is fed across a distance (a distance across which the leading end of original D at the step position passes paper discharge roller 17 by a predetermined distance) determined by the sizes of original D at the exposure position and step position, and a distance from the step position to paper discharge roller 17 (YES in ST808), the rotational speed of feed motor 141 is decreased, thus starting to decrease the original feed speed (ST810). Originals D at the step position and exposure position are discharged at the decreased feed speed to be aligned on paper discharge tray 18.

More specifically, the feed speed of the last original is decreased simultaneously with the original at the step position. In other words, an original other than the last original is decelerated after it is conveyed from the step position by a predetermined amount. However, the feed speed of the last original is decreased in synchronism with the feed speed of the immediately preceding original unlike in the feed operations of previous originals.

After the trailing end of original D at the exposure position passes paper discharge sensor 15, sensor 15 is turned OFF (YES in ST812). As for the last original, the step feed operation is not performed (NO in ST816). After an elapse of a predetermined period of time (ST818), feed motor 141 is stopped (ST820), and signal DF-ACT is disabled (ST822). When the original replace operation is performed (YES in ST824) not in the step feed operation (YES in ST816), the original discharge operation in response to signal ORG-OUT is an operation for feeding original Dl at the exposure position to paper discharge tray 18. If sensor 15 is turned OFF within a predetermined period of time (YES in ST828), the same control as in the original discharge operation in the original replace operation not in the step feed operation mode is performed (ST818 to ST822). The single-sided original feed operation is completed in this manner.

When the predetermined period of time elapses from the ON or OFF event of sensor 15 (NO in ST812, YES in ST814; NO in ST824, YES in ST826; NO in ST828, YES in ST830), or when the ON state of motor 141 continues for the predetermined period of time (YES in ST806) under a condition that sensor 15 is OFF (NO in ST804), it is determined that original D is jammed, and the operation is interrupted. The elapsed time at this time is checked by timer 200 shown in FIG. 3.

The double-sided original feed operation will be described below with reference to FIGS. 11A to 11I.

Figure 11A:
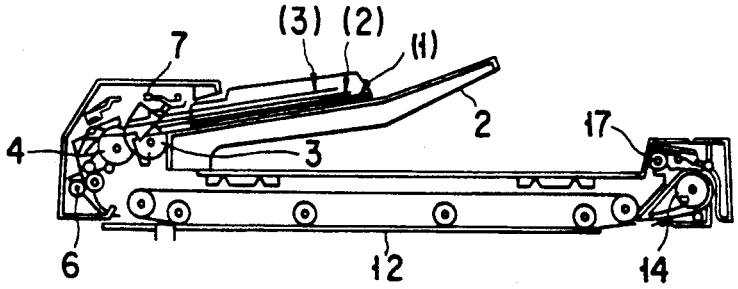
Figs. 11A to 11I are explanatory views sequentially showing original feed processes (steps A to I) when a double-sided original is fed.
Figure 11B:
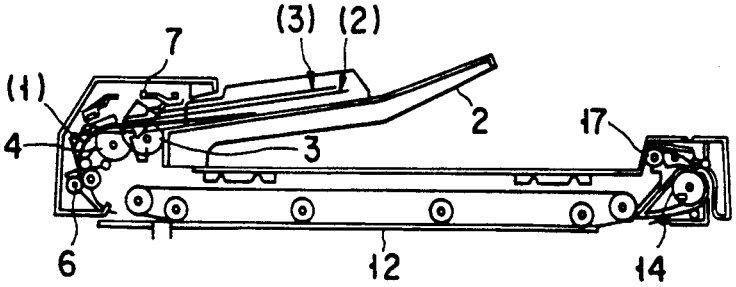
Figure 11C:
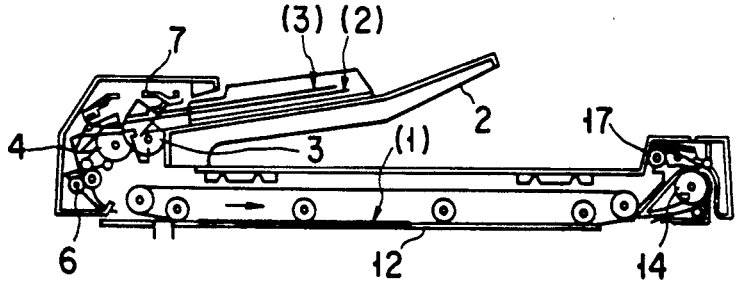
Figure 11D:
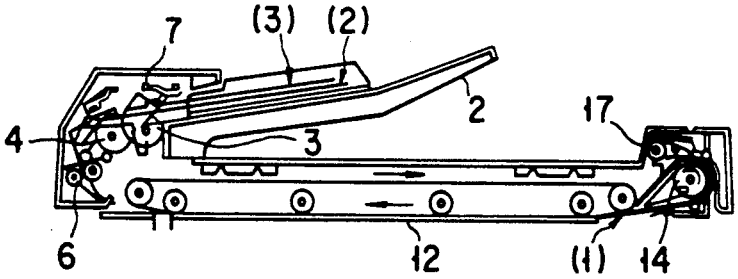
Figure 11E:
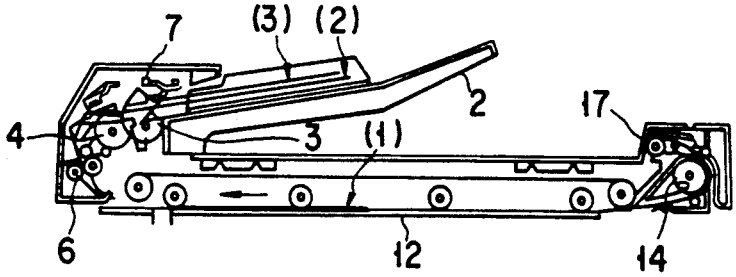
Figure 11F:
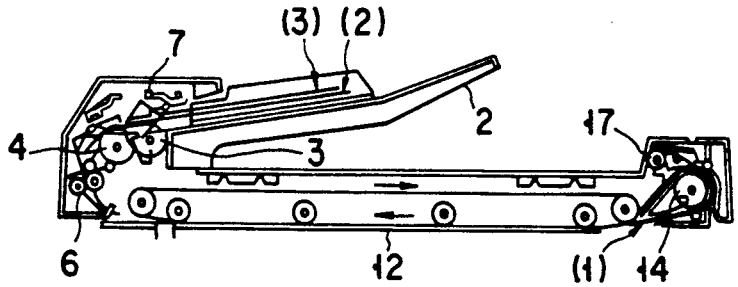
Figure 11G:
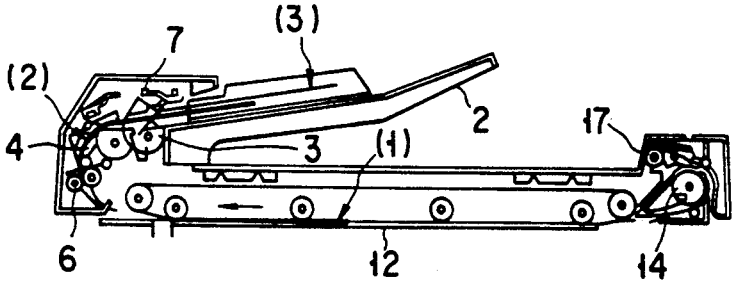

An operation until first original D is fed to the position of aligning roller pair 6 is the same as that in the single-sided original feed operation (see FIGS. 11A and 11B). When the leading end of original D is stopped at the position of aligning roller pair 6, feed motor 141 is rotated in the forward direction to rotate conveyor belt 12, reverse roller group 14, and paper discharge roller 17 in the discharge direction, thus performing the original discharge operation. This processing is performed when originals remain on original table 1. Upon completion of the discharge operations of remaining originals, clutch 142 is enabled to feed original D fed to the position of aligning roller pair 6 onto conveyor belt 12 (see FIG. 11C).

When original D passes size sensor 9 for detecting the original width in a direction perpendicular to the original feed direction, and the trailing end of original D passes regist sensor 8, processor 122 sets signals SIZE0 to SIZE3. After an elapse of a predetermined period of time from when the trailing end of original D passes regist sensor 8, processor 122 disables clutch 142, and enables flapper solenoid 143, thus setting flapper 16 in a direction to reverse original D. After an elapse of a predetermined time from when original D is fed along original table 1 by conveyor belt 12, and the leading end of original D passes paper discharge sensor 15 (at this time, the leading end of original D reaches a position between the reverse discharge section and belt roller 11 at the paper discharge side), processor 122 stops feed motor 141, and reverses the rotational direction of feed motor 141 (see FIG. 11D).

After an elapse of a predetermined period of time from when feed motor 141 is stopped, the reverse rotation of feed motor 141 is started to feed original D in a direction of original stopper 21. ADF processor 122 disables signal DF-ACT a predetermined period of time before the trailing end of original D reaches original stopper 21. When the leading end of original D reaches original stopper 21, processor 122 sets signal ORG-STP, and stops feed motor 141 (see FIG. 11E). The feed amount of original D at this time is determined by counting pulses output from first pulse generator 144 by counter 202 after the leading end of original D passes paper discharge sensor 15.

Figure 11H:
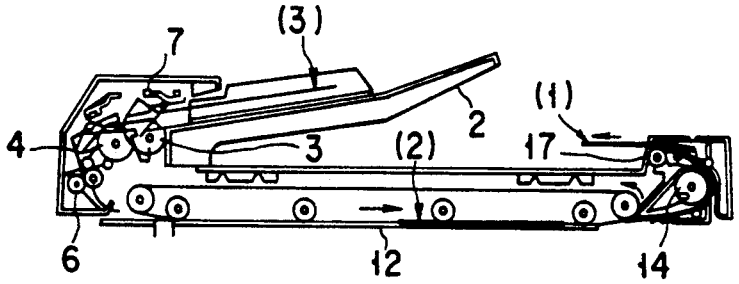
Figure 11I:
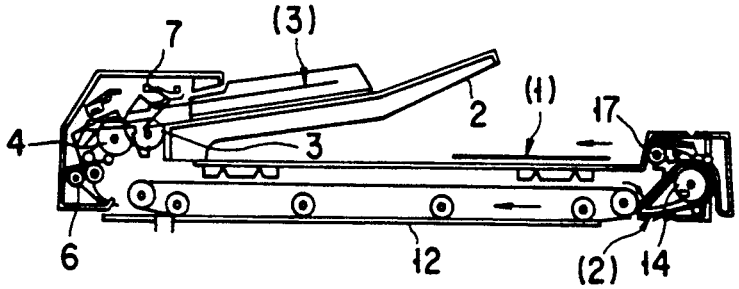

When signal ORG-STP is output, main processor 121 of the electronic copying machine starts an operation for scanning an original by a scanning system. Upon completion of scanning, main processor 121 outputs signal ORG-IN to reverse original D. Upon reception of signal ORG-IN, ADF processor 122 rotates feed motor 141 in the forward direction to start the feed operation of original D at the exposure position in a direction of the reverse discharge section. After original D is reversed by the reverse discharge section, reversed original D is fed to the exposure position (see FIGS. 11F and 11G). While reversed original D is being scanned, the presupply operation of second original D is performed. When the next signal ORG-IN is output from main processor 121, the auto document feeder replaces originals (FIGS. 11H and 11I).

Figure 12:
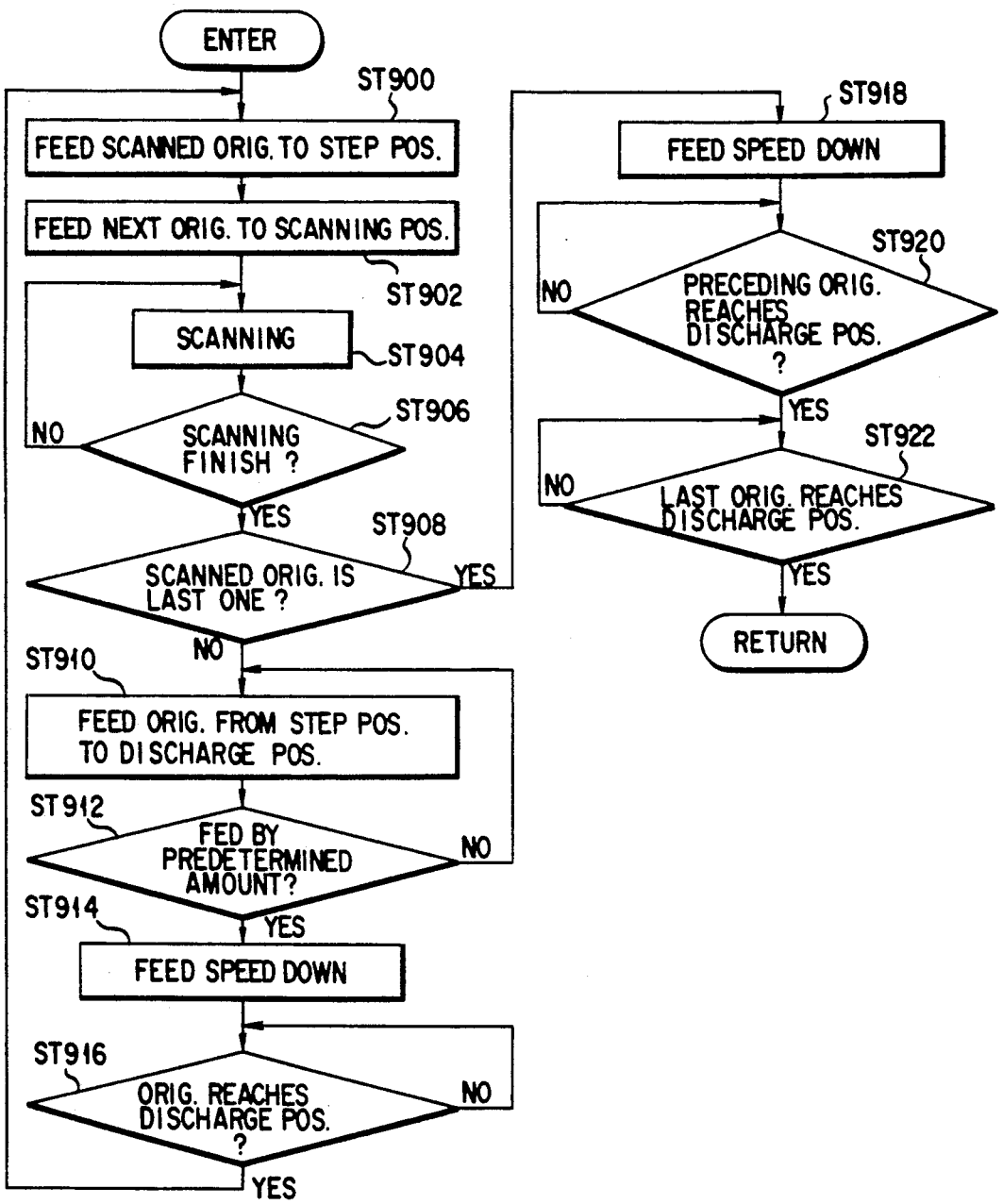
FIG. 12 is a flow chart for summarizing the paper discharge operation of the present invention.

To summarize, the auto document feeder of the present invention operates as follows. In FIG. 12, after an image-scanned original is fed to an intermediate position (stop position) (ST900), the next original is fed to the image scanning position (ST902). Upon completion of scanning (ST904) of the original at the image scanning position (YES in ST906), if this original is not the last original (NO in ST908), the original at the intermediate position is fed to the discharge section (ST910). When the original is fed from the intermediate position to the discharge section by a predetermined amount (YES in ST912), the original feed speed is decreased (ST914).

When the original at the intermediate position is fed to the discharge section (YES in ST916), another image-scanned original is simultaneously fed to the intermediate position (ST900). In this manner, original replace operations can be sequentially performed within a short period of time.

The image-scanned last original (YES in ST908) is not decelerated after it is fed by a predetermined amount by a third feed device, but is decelerated in advance so as not to contact the immediately preceding original (ST918) unlike previous originals. In this manner, a time from when the immediately preceding original is discharged on the discharge section (YES in ST920) until the leading end of the last original reaches a discharge port (YES in ST922) can be prolonged, and the last original is discharged after the immediately preceding original perfectly lands on the discharge section. Therefore, alignment of originals on the discharge section can be improved, and a stable discharge operation can always be performed.

As described above, according to the auto document feeder of the present invention, since the original step feed operation is performed, the original replace processing time can be shortened, and this feeder is particularly effective for a small-size original. Since the last original is fed at a decreased speed so as not to contact the immediately preceding original, not only alignment of originals on the discharge section can be improved, but also a stable discharge operation can always be performed.

Additional advantages and modifications will readily occur to those skilled in the art. Therefore, invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus including a paper supply section on which a plurality of originals can be placed, an original table having an image scanning position at which an image on the original is scanned, a discharge section for holding the originals, and means for feeding the original to the discharge section, said apparatus comprising:

means for sending the original to a predetermined position between the image scanning position and said discharge section;

first detection means for detecting whether or not the original is present in said paper supply section;

second detection means for detecting an original feed state wherein the original is already fed from the paper supply section to the image scanning position by said feeding means;

third detection means for detecting an original feed state wherein the original is already fed from the image scanning position to said discharge section by said feeding means; and means for controlling said feeding means and said sending means so as to parallel execute following operations under a condition that said first detection means detects a presence of the original, and said second detection means and said third detection means detect corresponding original feed states, i) an operation for feeding the original from said paper supply section to the image scanning position by said feeding means, ii) an operation for feeding the original fed to the image scanning position to the predetermined position by said sending means, and iii) an operation for feeding the original from the predetermined position to said discharge section by said feeding means.

2. An apparatus according to claim 1, wherein said controlling means includes:

means for measuring an original feed amount in the operation for feeding the original from the predetermined position to said discharge section by said feeding means; and means for decreasing an original feed speed after the original feed amount measured by said measuring means reaches a predetermined value.

3. An apparatus according to claim 2, wherein said controlling means further includes:

means for, when said first detection means does not detect the presence of the original, decreasing the feed speed of the original fed from the predetermined position to said discharge section by said feeding means regardless of the original feed amount measured by said measuring means, so that, when said first detection means does not detect the presence of the original, a last original does not collide against a preceding original in said discharge section.

4. An apparatus according to claim 1, wherein said feeding means and said original sending means commonly include means for moving the original.

5. An apparatus according to claim 1, wherein said controlling means includes means for executing:

a step feed operation for, when an original feed operation for replacing at least one of the plurality of originals already fed to the image scanning position with another one of the plurality of originals to be fed next is performed, temporarily stopping the one of the plurality of originals at the predetermined position without directly feeding the original to said discharge section.

6. An apparatus according to claim 5, wherein said controlling means includes:

means for checking a length of the fed original after said second detection means detects the original feed state; and means for, when a result of checking by said checking means indicates that the length of the original exceeds a predetermined value, stopping execution of the step feed operation.

7. An apparatus according to claim 6, wherein said controlling means includes means for executing:

a function for, when said stopping means already stops execution of the step feed operation, and when one of the plurality of originals already fed to the image scanning positions to be replaced with another one of the plurality of originals to be fed next, feeding the one original whose image has already been scanned at the image scanning position to said discharge section.

8. An auto document feeder comprising:

a paper supply section on which a plurality of originals are placed;

means for feeding the original on said paper supply section to an image scanning position, and discharging the original from the image scanning position;

a discharge section for holding the original discharged by said feeding means;

means for detecting that the original is placed on said paper supply section in a state wherein the original is fed to the image scanning position by said feeding means;

original feed amount detection means for detecting an original feed amount of the original fed from an intermediate position to said discharge section, said intermediate position being located between the image scanning position and the discharge section;

last original detection means for detecting whether or not the original fed by said feeding means is a last original; and means for, when said detecting means detects that the original is placed on said paper supply section, (i) controlling, when said feeding means feeds a next original to the image scanning position, so as to feed the next original to the image scanning position while feeding the original already present at the image scanning position to the intermediate position between, (ii) controlling, when the original is present at the intermediate position, so as to discharge the original at the intermediate position to said discharge section, and when the original feed amount from the intermediate position to said discharge section detected by said original feed amount detection means reaches a predetermined length, so as to decrease an original feed speed, and (iii) controlling, when said last original detection means detects the last original, so as to set a feed speed of the detected last original to be a decreased speed independently of the original feed amount detected by said original feed amount detection means, so that the last original does not contact the immediately preceding original.

* * * * *